US008674246B2

(12) United States Patent
Steffens

(10) Patent No.: US 8,674,246 B2
(45) Date of Patent: Mar. 18, 2014

(54) SWITCH ASSEMBLY OF A COOKING RANGE

(75) Inventor: Robert Chris Steffens, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1492 days.

(21) Appl. No.: 12/334,882

(22) Filed: Dec. 15, 2008

(65) Prior Publication Data

US 2010/0147658 A1 Jun. 17, 2010

(51) Int. Cl.
*H01H 19/04* (2006.01)
*G12B 9/00* (2006.01)

(52) U.S. Cl.
USPC ..... 200/296; 248/27.1

(58) Field of Classification Search
USPC ..... 74/10 R, 553; 200/11 R, 293–296, 316, 200/336, 564; 248/27.1, 27.3
See application file for complete search history.

(56) References Cited

U.S. PATENT DOCUMENTS

| | | | | |
|---|---|---|---|---|
| 4,434,339 | A * | 2/1984 | Ohashi | 200/295 |
| 4,653,708 | A * | 3/1987 | Rich | 248/27.1 |
| 4,892,987 | A * | 1/1990 | Aframian | 200/296 |
| 5,225,970 | A * | 7/1993 | Palumbo | 361/807 |
| 5,256,841 | A * | 10/1993 | Zanella | 200/296 |
| 5,323,297 | A * | 6/1994 | Palumbo et al. | 361/809 |
| 6,287,154 | B1 | 9/2001 | Palmer et al. | |
| 6,376,770 | B1 | 4/2002 | Hyde | |
| 6,997,739 | B2 | 2/2006 | Hoxha | |
| 7,030,319 | B2 | 4/2006 | Johnsen et al. | |
| 7,122,740 | B2 | 10/2006 | Xu et al. | |
| 7,202,433 | B2 * | 4/2007 | Howie | 200/565 |

* cited by examiner

*Primary Examiner* — Phillip A. Johnson

(57) ABSTRACT

A control switch for a cooking range includes a mounting plate configured to be mounted in a control panel of the cooking range and a snap lock defined in the mounting plate. The snap lock includes a catch that orients the control switch in the control panel. The mounting plate also includes a keyed tab shaped to match the profile of the catch of the snap lock.

16 Claims, 5 Drawing Sheets

SWITCH ASSEMBLY OF A COOKING RANGE

TECHNICAL FIELD

The present disclosure relates generally to control switches for cooking ranges and more particularly to the mounting plates of control switches for cooking ranges.

BACKGROUND

A cooking range is used to cook meals and other foodstuffs on a cooking surface or within an oven. Ranges typically include various control switches and electronics to control the heating elements of the cooking range.

SUMMARY

According to one aspect, a switch assembly for a cooking range is disclosed. The switch assembly may include an appliance control switch having a body with a rotating shaft extending outwardly therefrom, and a mounting plate secured to the body. The mounting plate may be configured to mount the control switch to a control panel of the cooking range. The mounting plate may include a resilient tongue having a catch formed therein to engage with a cutout of the control panel, and a keyed tab shaped to match the profile of the catch.

In some embodiments, the mounting plate may include an arm and the body including a slot. The arm of the mounting plate may be received in the slot of the body to secure the mounting plate to the body.

In some embodiments, the mounting plate may further include a frame secured to the body of the control switch and a lower platform extending from the frame. The lower platform may have an upper surface configured to contact the control panel of the cooking range. The mounting plate also may include an upper platform spaced apart from the lower platform. The upper platform may have a lower surface configured to contact the control panel of the cooking range.

In some embodiments, the keyed tab may be formed in the upper platform. In some embodiments, both the catch of the tongue and the keyed tab of the upper platform may be semi-circular in shape. Additionally, in some embodiments, only the catch of the tongue may be semi-circular in shape. In some embodiments, the lower surface of the upper platform may be tapered.

In some embodiments, the upper platform may be generally square-shaped with the keyed tab forming one of its four corners. In some embodiments, the mounting plate may include an aperture extending therethrough, and the rotating shaft of the control switch may extend through the aperture.

According to another aspect, a control switch mounting plate for a cooking range is disclosed. The control switch mounting plate may include a frame configured to be secured to an appliance control switch and a lower platform extending from the frame. The lower platform may be configured to contact a control panel of the cooking range when the mounting plate is mounted on the control panel. The control switch mounting plate may include an upper platform spaced apart from the lower platform such that the control panel is captured between the upper platform and the lower platform when the mounting plate is mounted on the control panel. The control switch mounting plate may include a resilient tongue having a catch formed. The catch may be configured to engage a cutout of the control panel when the mounting plate is mounted on the control panel. The control switch mounting plate may include a keyed tab shaped to match the profile of the catch.

In some embodiments, the control switch mounting plate may also include a pair of arms configured to be received into slots formed in the control switch. In some embodiments, the upper platform may include a lower surface that contacts the control panel when the mounting plate is mounted to the control panel, and the lower surface of the upper platform may be tapered. In some embodiments, both the catch of the tongue and the keyed tab of the upper platform may be semi-circular in shape.

According to another aspect, a method of mounting an appliance control switch to a control panel of an appliance. The method may include the step of securing a mounting plate to the appliance control switch. The mounting plate may include a resilient tongue having a catch formed therein and a keyed tab. The method may also include the steps of aligning the keyed tab of the mounting plate with a complimentary-sized opening formed in a cutout of the control panel, advancing the keyed tab through the complimentary-sized opening formed in the cutout, and rotating the control switch relative to the control panel such that the catch of the tongue is positioned in the complimentary-sized opening formed in the cutout.

In some embodiments, the complimentary-sized opening in the cutout may include a rounded opening and both the catch of the tongue and the keyed tab are rounded. The advancing step may include advancing the rounded keyed tab through the rounded opening formed in the cutout.

In some embodiments, the tongue of the mounting plate may be deflected away from the control panel during the rotating step prior to being positioned in the complimentary-sized opening.

BRIEF DESCRIPTION OF THE DRAWINGS

The detailed description particularly refers to the following figures, in which.

DETAILED DESCRIPTION OF THE DRAWINGS

Figure 1:
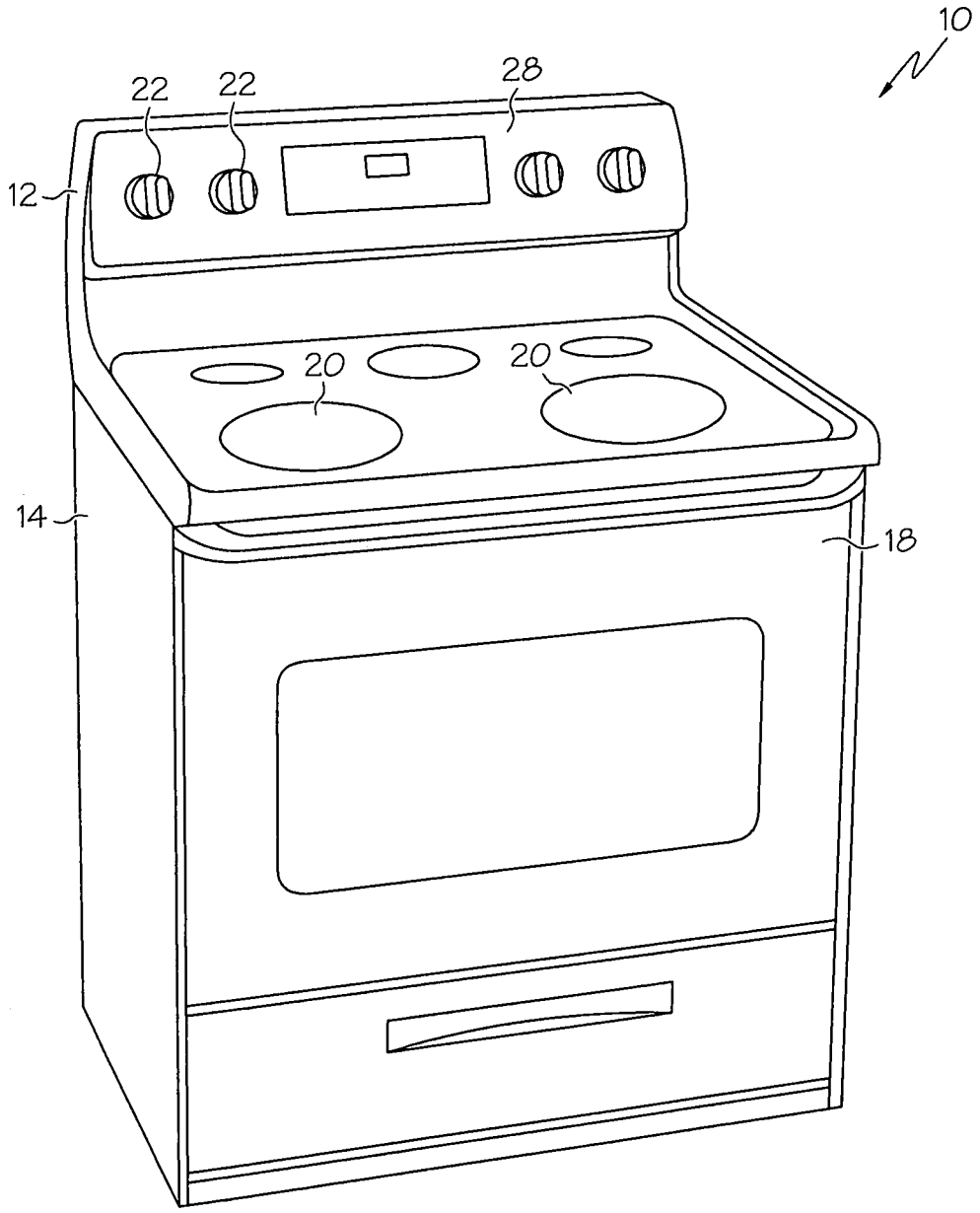
FIG. 1 is a perspective view of a cooking range including a control panel.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, there is shown a cooking range 10. The range 10 includes an oven 18 positioned below a cooking surface that includes a number of heating elements 20 operable to heat pots, pans, and the like to desired cooking temperatures. The oven 18 is positioned in a housing 14, which also supports the range's cooking surface. The range also includes a control panel 12. A user may control the heating elements 20 using a set of knobs 22 positioned on a front surface 28 of the control panel 12. As the user rotates one of the knobs 22, a control switch 30 (see FIG. 2) coupled to the knob 22 adjusts the heat generated by the corresponding heating element 20.

Figure 2:
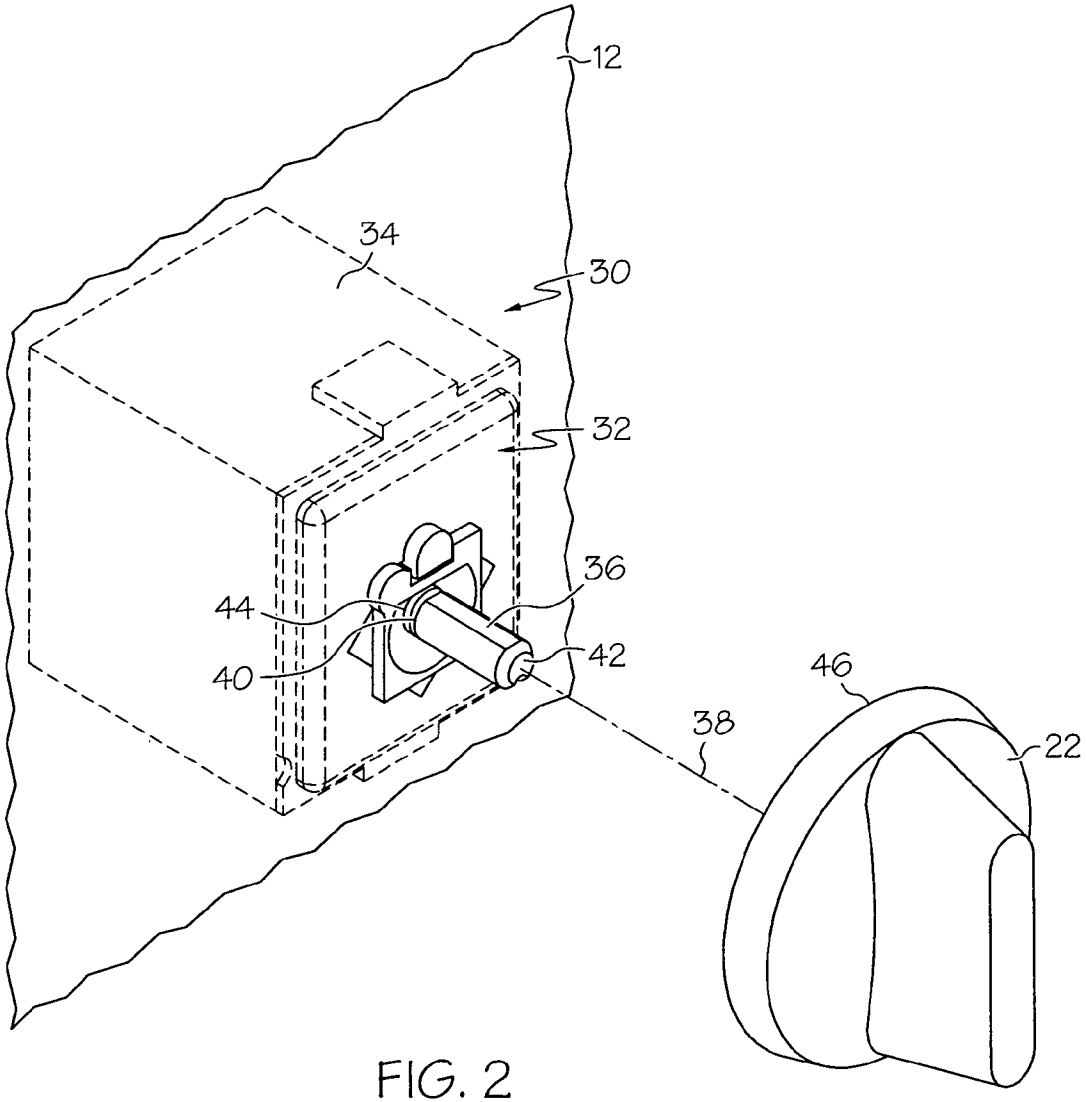
FIG. 2 is a fragmentary perspective view of one embodiment of a control switch mounted in the control panel of the cooking range of FIG. 1.
Figure 3:
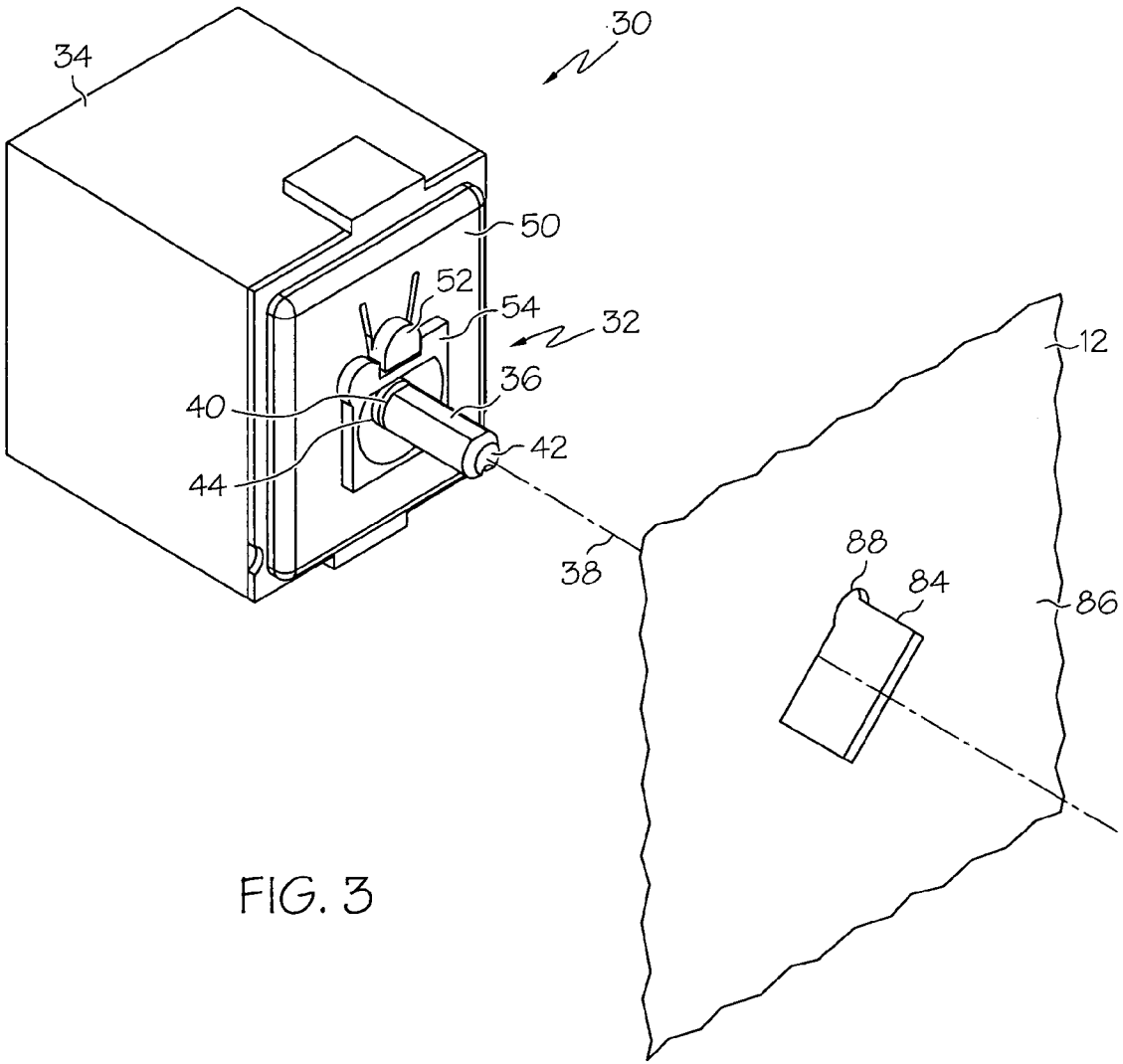
FIG. 3 is a fragmentary perspective view of the control switch of FIG. 2 spaced apart from the control panel of the cooking range of FIG. 1.
Figure 4:
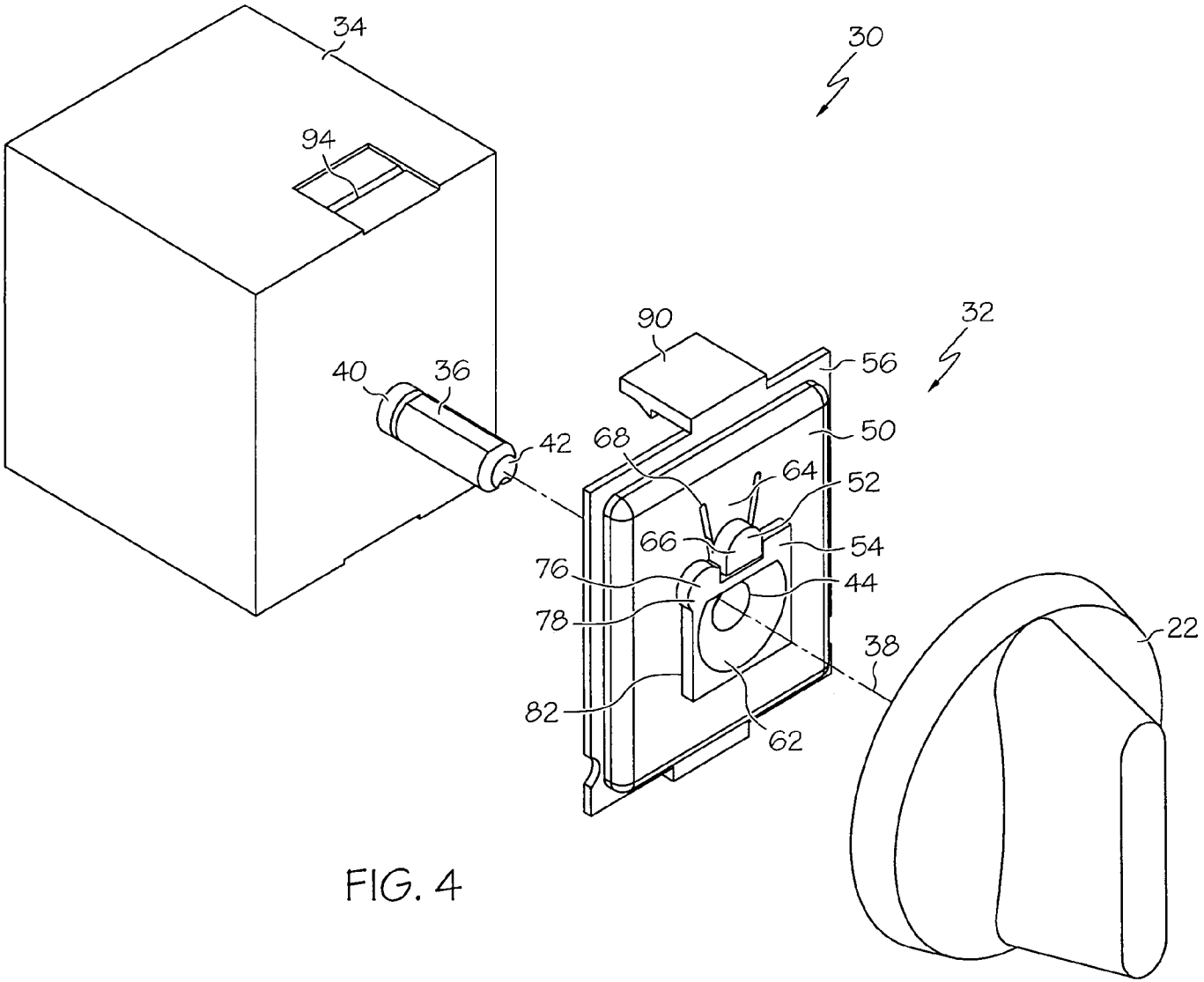
FIG. 4 is an exploded perspective view of the control switch of FIG. 2.

Referring to FIGS. 2 and 3, the control switch 30 is shown in greater detail, along with a mounting plate 32 for mounting the control switch 30 to the control panel 12 of the range 10. The control switch 30 includes a body 34 having rotating shaft 36 extending outwardly therefrom. As shown in FIG. 4, the shaft 36 extends out of the switch body 34 through a collar 40. A distal end 42 that passes through an aperture 44 formed in the mounting plate 32 and is received in a hole (not shown) formed in the back 46 of the control knob 22. The control knob 22 is sized such that the control switch 30 is concealed from view when the shaft 36 is fully seated in the control knob 22. The control switch 30 is a component of the range's control circuit, and, as such, is operable to control one of the heating elements 20. Namely, a user may turn the control knob 22 in a desired direction to selectively increase or decrease the heat generated by the heating element.

As shown in FIG. 4, the front side of the control switch 30 is secured to the back side of the mounting plate 32. Specifically, the mounting plate 32 includes a frame 56 having a pair of arms 90 extending therefrom. Each arm 90 includes a catch 92 configured to be received in a corresponding slot 94 formed in the switch body 34. In this way, the mounting plate 32 is secured to the switch body 34.

As alluded to above, the mounting plate 32 is used to secure the control switch 30 to the control panel 12. The mounting plate 32 includes a lower platform 50, a snap lock 52, and an upper platform 54. As will be discussed in more detail below, the upper platform 54 is spaced apart from the lower platform 50 such that the control panel 12 of the range 10 is placed between the upper platform 54 and the lower platform 50 when the control switch 30 is secured to the control panel 12. The snap lock 52 engages with the control panel 12 to orient the control switch 30 and prevent it from rotating relative to the control panel 12. Namely, when mounted to the control panel 12 by the mounting plate 32, the switch body 34 is fixed in position, but the shaft 36 is free to rotate when the user rotates the control knob 22 about an axis 38.

Figure 5:
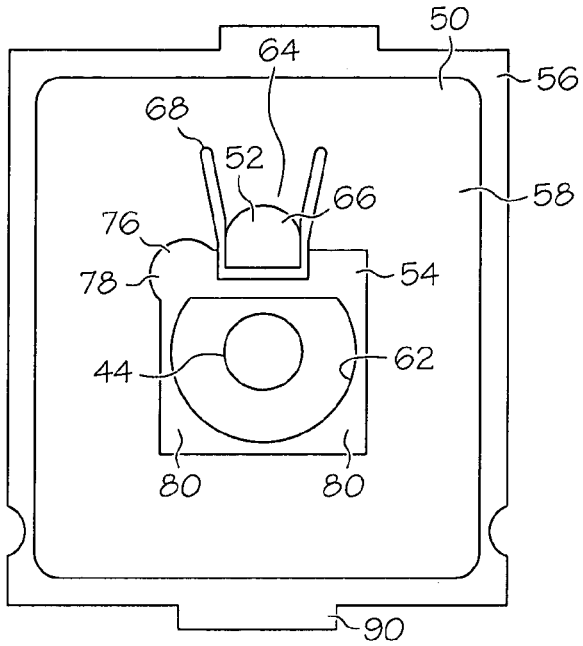
FIG. 5 is a front elevation view of one embodiment of a mounting plate of the control switch of FIG. 2.
Figure 6:
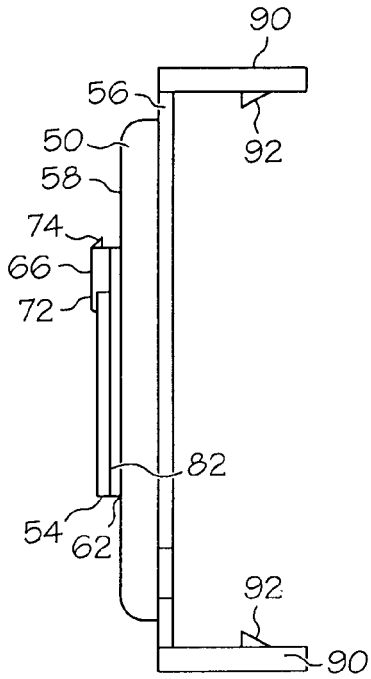
FIG. 6 is a side elevation view of the mounting plate of FIG. 5.
Figure 7:
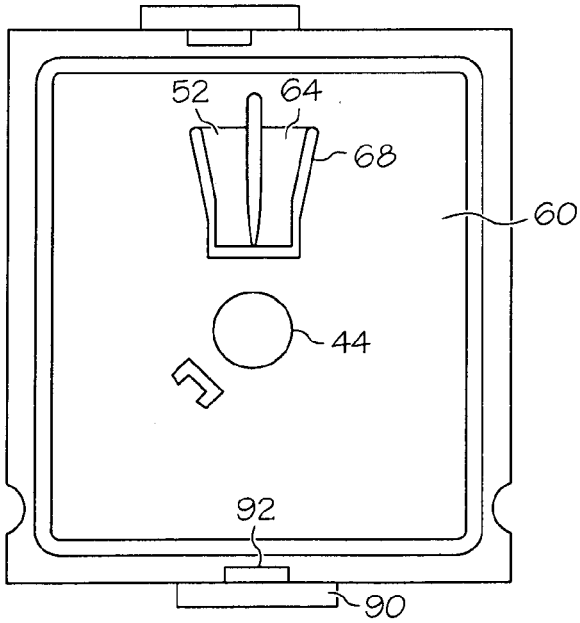
FIG. 7 is a rear elevation view of the mounting plate of FIG. 6.

As best seen in FIGS. 5-7, the lower platform 50 extends outwardly from the frame 56. The lower platform 50 has a panel-facing surface 58 and a switch-facing surface 60. The panel-facing surface 58 contacts the rear surface of the control panel 12 when the control switch 30 is secured to the control panel 12. A D-shaped enclosure 62 extends upwardly from the panel-facing surface 58 and connects the lower platform 50 to the upper platform 54. The aperture 44 extends from the switch-facing surface 60 to the panel-facing surface 58 and opens within the D-shaped enclosure 62.

The snap lock 52 is defined in the lower platform 50 and includes a resilient locking tongue 64 having a catch 66 formed in its distal end. The tongue 64 extends in an opening 68 formed in the lower platform 50. In the illustrative embodiment described herein, the catch 66 has a semi-circular shape. It should be appreciated that in other embodiments the catch 66 may be square, triangular, or any other suitable shape. The catch 66 engages the front surface 28 of the control panel 12 when the control switch 30 is secured to the control panel 12.

The upper platform 54 is formed at the top of the enclosure 62. The upper platform 54 has a substantially square-shaped profile with a rounded corner 76 configured to match the shape of the catch 66. The rounded corner 76 extends outwardly from the enclosure 62 to form a keyed tab 78. In the illustrative embodiment, the keyed tab 78 has a semi-circular shape that matches the shape and size of the catch 66 described above. The remaining corners of the upper platform 54 extend outwardly from the enclosure 62 to form a number of squared edges 80. The upper platform 54 has a panel-facing surface 82 that is tapered and placed into contact with the front surface 28 of the control panel 12 when the control switch 30 is secured to the control panel 12. In the illustrative embodiment, the panel-facing surface 28 has a helical taper. It should be appreciated that in other embodiments other taper configurations may be used. The panel-facing surface 82 of the upper platform 54 is spaced apart from the panel-facing surface 58 of the lower platform 50.

Referring to FIG. 3, the control panel 12 has a cutout 84 defined in a wall 86 configured to match the profile of the upper platform 54. That is, the cutout 84 is substantially square-shaped with a corner 88 having a semi-circular shape that matches the shape of the keyed tab 78 of the upper platform 54 and the catch 66 of the snap lock 52.

During installation, the user rotates the control switch 30 about the axis 38 to align the keyed tab 78 of the upper platform 54 with the corresponding rounded corner 88 of the cutout 84. In this orientation, the upper platform 54 may pass through the cutout 84. When the upper platform 54 passes through the cutout 84, the panel-facing surface 58 of the lower platform 50 is placed in contact with the rear surface of the control panel 12. Additionally, the rear surface of the control panel 12 contacts a front surface 72 of the catch 66 and presses on the catch 66 such that the tongue 64 is deflected away from the control panel 12.

After the upper platform 54 is through the cutout 84, the user may then rotate the control switch 30 about the axis 38. In the illustrative embodiment, the user rotates the control switch 30 approximately one-eighth of a full turn about the axis 38. The panel-facing surface 82 of the upper platform 54 is placed into contact with the front surface 20 of the control panel 12 as the control switch 30 is rotated about axis 38. In doing so, the wall 86 of the control panel 12 is captured between the upper platform 54 and lower platform 50. The taper of the panel-facing surface 82 of the upper platform 54 ensures that the wall 86 is tightly secured between the upper platform 54 and the lower platform 50.

When the catch 66 is aligned with the rounded corner 88 of the cutout 84, the resilient tongue 64 urges or snaps the catch 66 into the rounded corner 88 of the cutout 84. A lip 74 of the catch 66 engages with the front surface 20 of the control panel 12. In this way, the control switch 30 is locked into position and prevented from rotating further.

To release the control switch 30, the user first presses on the front surface 72 of the catch 66 until the catch 66 is clear from the rounded corner 88. It should be appreciated a tool may be used to facilitate the removal of the catch 66 from the rounded corner 88. The user then rotates the control switch 30 about the axis 38 to align the keyed tab 78 with the rounded corner 88. Once aligned, the user may pull the control switch 30 free from the control panel 12.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. An appliance control switch assembly for a cooking range, comprising:

a control switch body;

a rotating shaft extending outwardly from the body; and a mounting plate secured to the body, the mounting plate being configured to mount the control switch to a control panel of a cooking range, wherein the mounting plate comprises: (i) a resilient tongue having a catch formed therein to engage with and extend through a cutout of the control panel, and (ii) a keyed tab shaped to match the profile of the catch.

2. The switch assembly of claim 1, wherein:

the mounting plate includes an arm, the body includes a slot, and the arm of the mounting plate is received in the slot of the body to secure the mounting plate to the body.

3. The switch assembly of claim 1, wherein the mounting plate further comprises:

a frame secured to the body of the control switch, a lower platform extending from the frame, the lower platform having an upper surface configured to contact the control panel of the cooking range, and an upper platform spaced apart from the lower platform, the upper platform having a lower surface configured to contact the control panel of the cooking range.

4. The switch assembly of claim 3, wherein the keyed tab is formed in the upper platform.

5. The switch assembly of claim 4, wherein both the catch of the tongue and the keyed tab of the upper platform are semi-circular in shape.

6. The switch assembly of claim 3, wherein the lower surface of the upper platform is tapered.

7. The switch assembly of claim 3, wherein the upper platform is generally square-shaped with the keyed tab forming one of the upper platform's four corners.

8. The control switch of claim 1, wherein the catch of the tongue is semi-circular in shape.

9. The control switch of claim 1, wherein:

the mounting plate includes an aperture extending therethrough, and the rotating shaft of the control switch extends through the aperture.

10. A control switch mounting plate for a cooking range, comprising:

a frame configured to be secured to an appliance control switch body, a lower platform extending from the frame, the lower platform is configured to contact a control panel of the cooking range, a generally square-shaped upper platform spaced apart from the lower platform such that the upper platform is configured to extend through an aperture in the control panel, the control panel being captured between the upper platform and the lower platform, a resilient tongue having a catch formed thereon, the catch being configured to engage a cutout of the control panel when the mounting plate is mounted on the control panel, and a keyed tab shaped to match the profile of the catch, wherein the keyed tab forming one of the generally square-shaped upper platform's four corners.

11. The mounting plate of claim 10, further comprising a pair of arms configured to be received into slots formed in the control switch.

12. The mounting plate of claim 10, wherein: the upper platform includes a lower surface that contacts the control panel when the mounting plate is mounted to the control panel, and the lower surface of the upper platform is tapered.

13. The mounting plate of claim 10, wherein both the catch of the tongue and the keyed tab of the upper platform are semi-circular in shape.

14. A method of mounting an appliance control switch to a control panel of an appliance, comprising:

securing a mounting plate to the appliance control switch, the mounting plate comprising (i) a resilient tongue having a catch formed therein to engage with and extend through a cutout of the control panel, and (ii) a keyed tab shaped to match the profile of the catch, aligning the keyed tab of the mounting plate with a complimentary-sized opening formed in a cutout of the control panel, advancing the keyed tab through the complimentary-sized opening formed in the cutout, and rotating the control switch relative to the control panel such that the catch of the tongue is positioned in the complimentary-sized opening formed in the cutout.

15. The method of claim 14, wherein; the complimentary-sized opening in the cutout comprises a rounded opening, both the catch of the tongue and the keyed tab are rounded, and the advancing step comprises advancing the rounded keyed tab through the rounded opening formed in the cutout.

16. The method of claim 14, wherein the tongue of the mounting plate is deflected away from the control panel during the rotating step prior to being positioned in the complimentary-sized opening.

* * * * *